US007527183B2

(12) United States Patent
Maffei

(10) Patent No.: US 7,527,183 B2
(45) **Date of Patent: *May 5, 2009**

(54) CARDBOARD TOOL FOR OPENING GLASS AMPOULES

(75) Inventor: Camilla Maffei, Pistoia (IT)

(73) Assignee: Project S.A.S. Di Massimo Menichelli & C., Pistoia (IT)

( * ) Notice: Subject to any disclaimer, the term of this patent is extended or adjusted under 35 U.S.C. 154(b) by 287 days.

This patent is subject to a terminal disclaimer.

(21) Appl. No.: 10/524,642

(22) PCT Filed: Aug. 4, 2003

(86) PCT No.: PCT/IT03/00494

§ 371 (c)(1),
(2), (4) Date: Feb. 14, 2005

(87) PCT Pub. No.: WO2004/018344

PCT Pub. Date: Mar. 4, 2004

(65) Prior Publication Data

US 2006/0112571 A1 Jun. 1, 2006

(30) Foreign Application Priority Data

Aug. 21, 2002 (IT) ..... FI2002A0159

(51) Int. Cl.
*B65D 85/42* (2006.01)

(52) U.S. Cl. ..... 225/93; 206/532; 206/538

(58) Field of Classification Search ..... 225/1, 225/93, 96.5, 103, 105; 241/99, 606, 168; 206/532, 528; 81/3.4, 3.44; D24/127, 131, D24/132

See application file for complete search history.

(56) References Cited

U.S. PATENT DOCUMENTS

| | | | | | |
|---|---|---|---|---|---|
| 1,682,106 | A | * | 8/1928 | Banks | 40/322 |
| 2,503,517 | A | | 4/1950 | Sirica | |
| 3,115,247 | A | * | 12/1963 | Hauser | 206/528 |
| 4,241,627 | A | * | 12/1980 | Snow | 81/3.55 |

FOREIGN PATENT DOCUMENTS

| | | | |
|---|---|---|---|
| DE | 24 53 309 | | 5/1976 |
| EP | 0784015 | * | 7/1997 |
| FR | 2 364 207 | | 9/1976 |
| FR | 2451742 | * | 11/1980 |
| FR | 2 550 170 | | 2/1985 |
| FR | 2 703 336 | | 10/1994 |
| FR | 2 744 437 | | 8/1997 |
| GB | 749091 | | 5/1956 |
| WO | WO-0034938 | * | 6/2000 |

* cited by examiner

*Primary Examiner*—Stephen Choi
(74) *Attorney, Agent, or Firm*—McGlew and Tuttle, P.C.

(57) ABSTRACT

The tool consists of a strip of cardboard (1A, 1B) with a hole (3) in an intermediate position and at least one weakening for a transverse fold (5) coinciding with said hole, so as to delimit two facing leaves (1A, 1B); the neck of the vial (F) is introduced into the hole (3) and the leaves (1A, 1B) are able to be arranged alongside the neck (C) of the vial and receive the action of the fingers (fT) in order to break said neck.

20 Claims, 13 Drawing Sheets

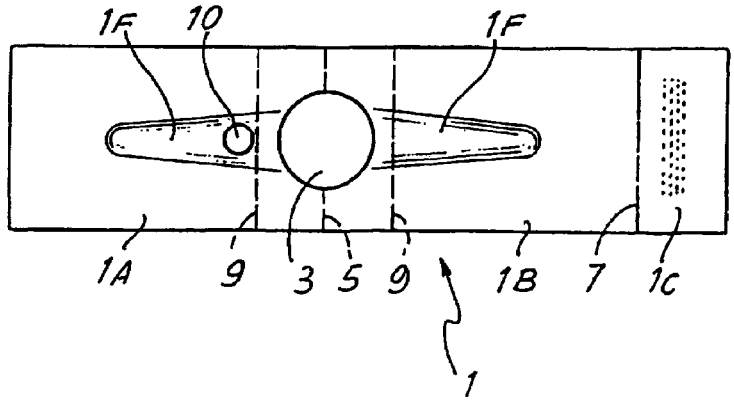
Fig.1
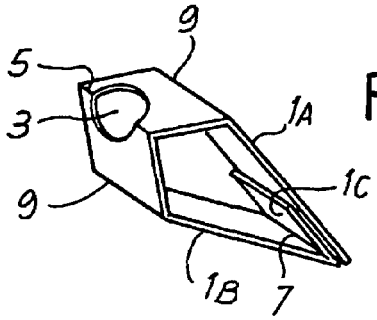
Fig.2
Fig. 3
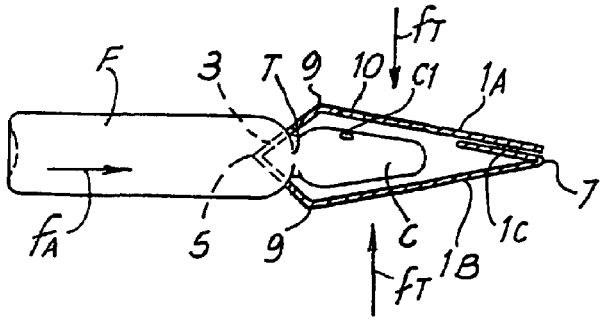
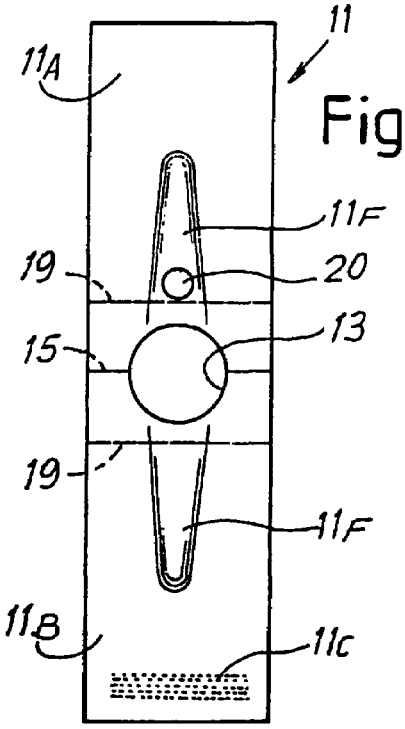
Fig.4
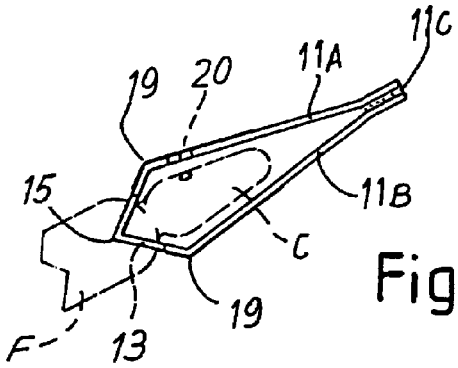
Fig.5

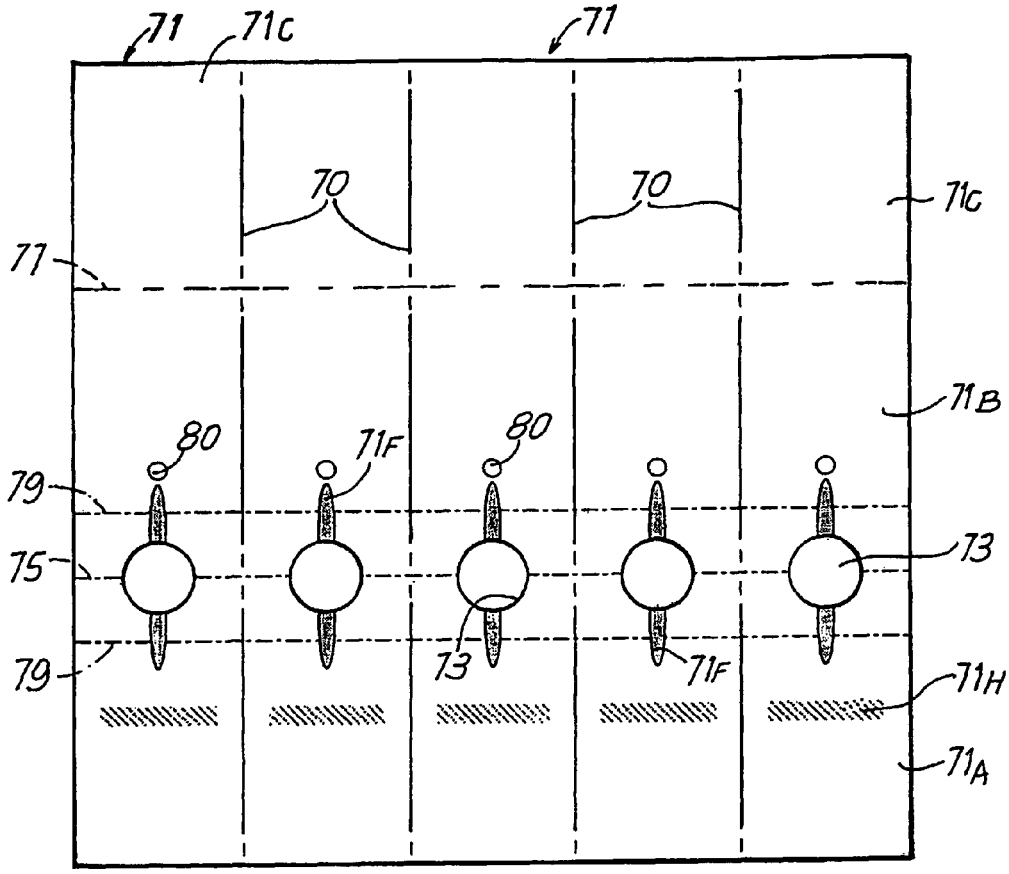
Fig. 11
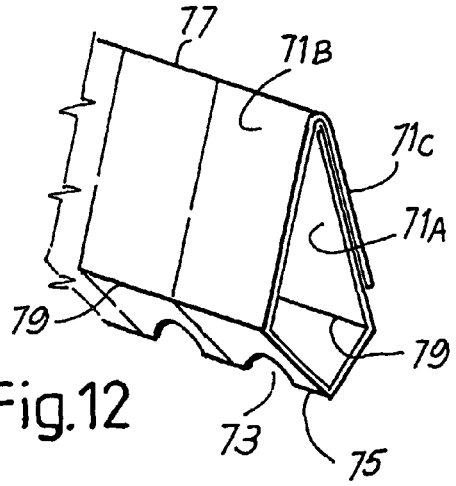
Fig.12
Fig 13
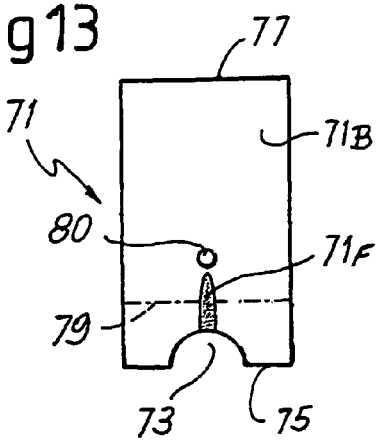

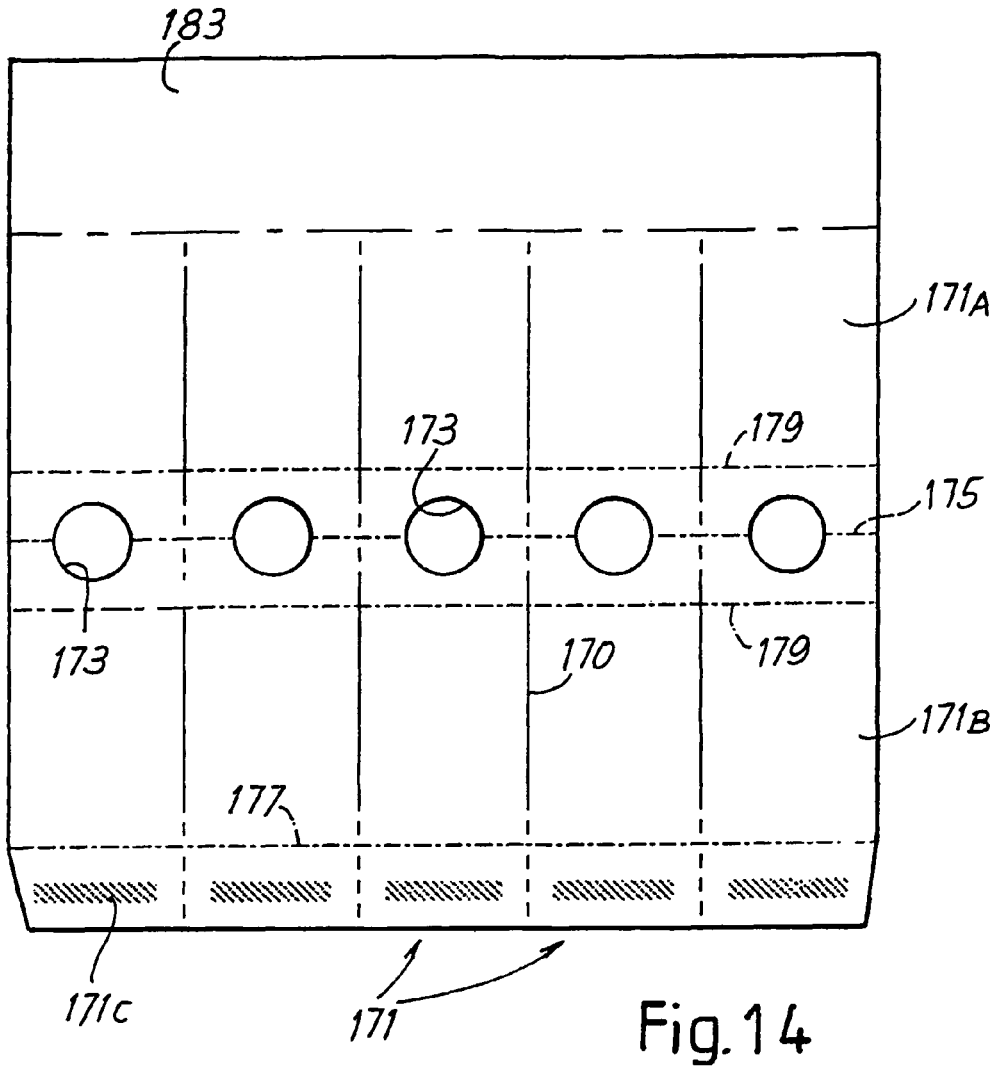
Fig. 14
Fig. 15
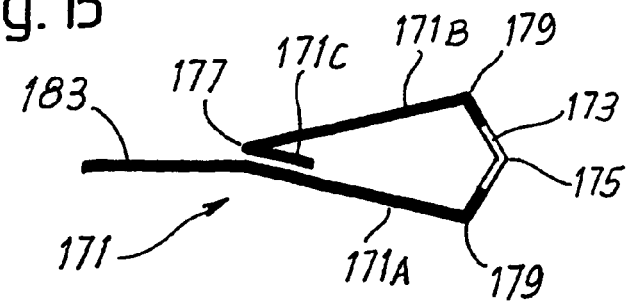

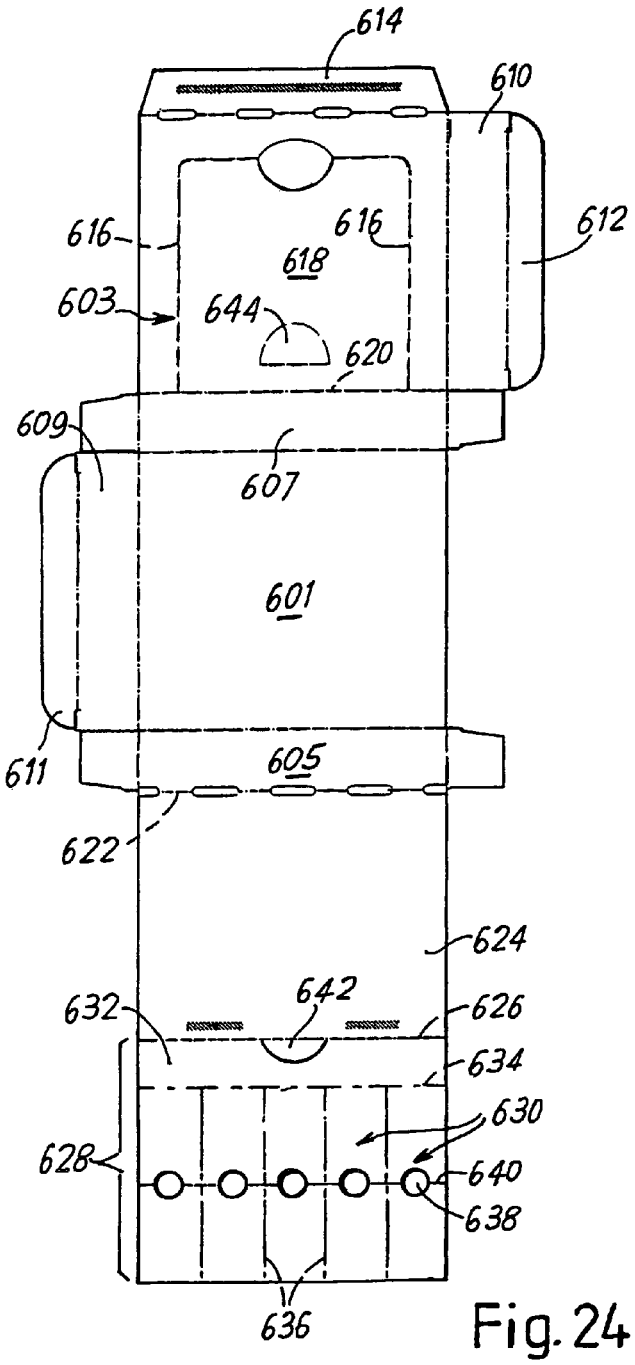
Fig. 24
Fig. 25
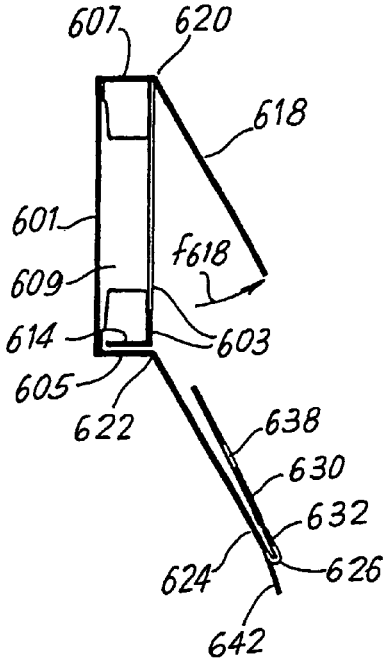

CARDBOARD TOOL FOR OPENING GLASS AMPOULES

In the field of pharmaceutical products in sealed glass phials, hitherto the problem of opening the phial by breaking a specially provided zone of the neck of the phial has not been solved. Manual opening results in possible and frequent risk of injury to the hands. Special tools for the specific operation are unsatisfactory because they are costly per se and costly to include within the packaging because they occupy a large amount of space within a single package containing a limited number of phials, as well as being costly because they are intended to be disposed of together with the empty package.

The invention solves the problems relating to the provision of a tool which is disposable after being used once or in any case a limited number of times and the problems relating to handling of the packaging. The invention also solves the problems of facilitating breakage of the neck of the phial by the operator under safe conditions since the operator is protected from injury to the fingers. These and other objects and advantages will become clear from the text which follows.

Essentially the tool in question—in order to facilitate breakage of the neck of a glass phial for pharmaceuticals and the like—consists of a strip of cardboard with a hole in a middle position and at least one weakening for a transverse fold coinciding with said hole, so as to delimit two facing leaves; the hole is suitable for the introduction therein of the phial neck and the leaves are able to be arranged alongside the neck of the phial and receive the action of the fingers for breaking said neck.

In one possible solution, the two leaves are joined together at the ends opposite to the hole.

Advantageously each of the two leaves has a first weakening for a transverse fold at a small distance from said hole, for adaptation to the shape of the neck of the phial. Furthermore each of the two leaves may also have a second additional weakening for a transverse fold at a greater distance from said hole than said first additional weakening for a transverse fold; in this case it is possible to obtain inwards folding of the cardboard between the two leaves in order to adapt the tool to the shoulder of the phial and to the neck thereof.

Each of the two leaves may have an impression for facilitating folding, i.e. a longitudinal rib which is shaped and convex outwards from said hole for the neck of the phial; a partial housing for the neck of the phial is thus created.

At least one of the leaves may have a window which allows visual inspection of a reference mark which is frequently provided on the neck of the phial in order to indicate the direction of the pressure to be exerted for breaking the neck of the phial.

In a more generic solution the tool for facilitating breakage of the neck of a glass phial may consist of a cardboard element with at least one weakening for a book-like fold, so as to define two facing leaves with recesses able to form a seat for the neck of the phial; the two leaves are able to be arranged alongside the neck of the phial and receive the action of the fingers so as to break the neck of the phial.

A tool may even consists of a strip of cardboard with a weakening for a transverse fold so as to define two facing leaves with recesses at the ends able to form a seat for receiving the neck of the phial; the two leaves are able to be arranged alongside the neck of the phial and receive the action of the fingers for breaking said neck.

The invention also relates to a set of tools as defined; this set may consist of punched cardboard material with pre-cut lines defining the individual tools to be detached easily one after another for use.

Such a set of tools may be made using cardboard material comprising a surface which is in excess of that forming the tools to be detached; this excess surface may be used for printing information relating to use of the tools and/or of a promotional nature and/or concerning the product—in particular pharmaceutical product—contained in the phial of a packaging which may also contain said set of tools.

A set of tools, as defined above, may be formed as an appendage to a punched element for creation of a box suitable for forming the phial packaging for which said set is intended; said appendage may be handled during the operations for formation of the box, being hinged by means of at least one folding line with a component of said punched element.

The invention will be better understood with reference to the description and the attached drawing, which shows a non-limiting example of embodiment of said invention. In the drawing:

FIGS. 1, 2 and 3 show a view in the open condition, perspective view in the condition ready for use and a cross-section during use of a first example of a tool;

FIGS. 4 and 5 show a second example of a tool in the open condition and at the time of use;

FIGS. 11 and 12 show a set of tools in the open condition and connected together and partially in the condition for use but before being separated;

FIG. 13 shows a detached tool;

Figure 20:
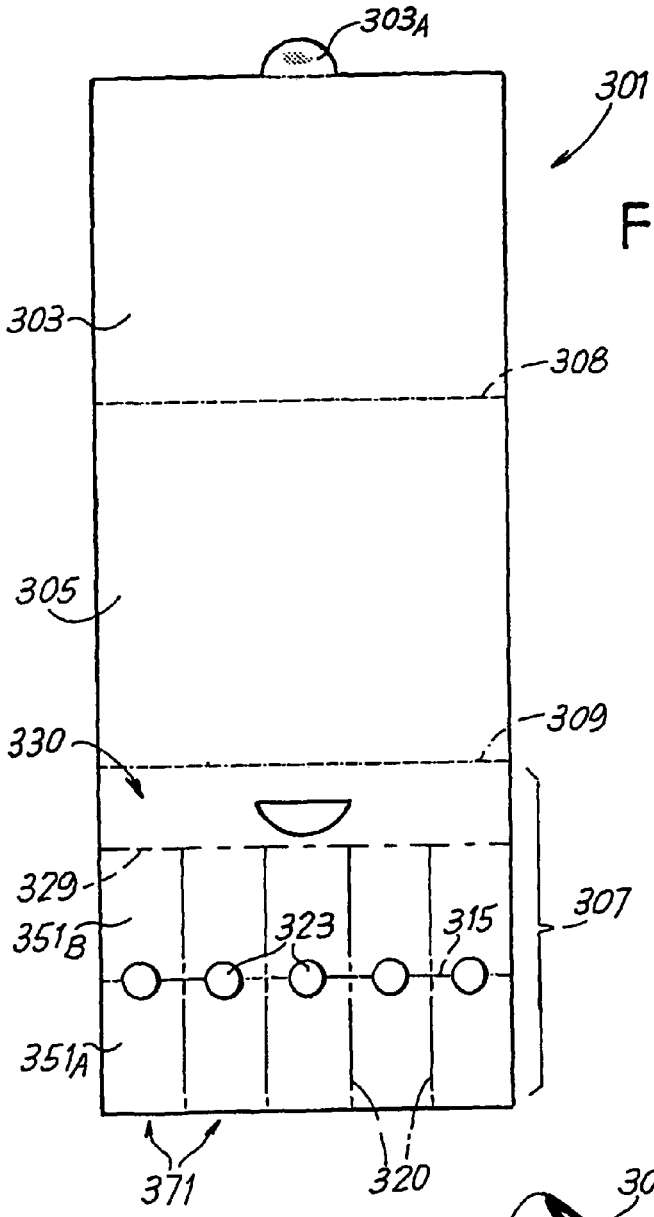
Figure 21:
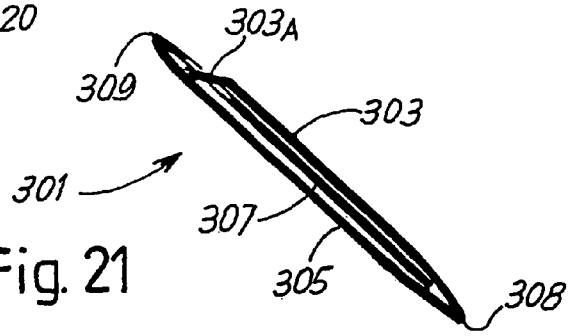
Figure 23:
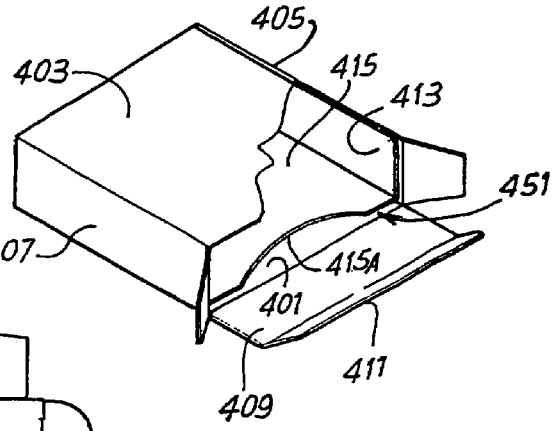
Figure 22:
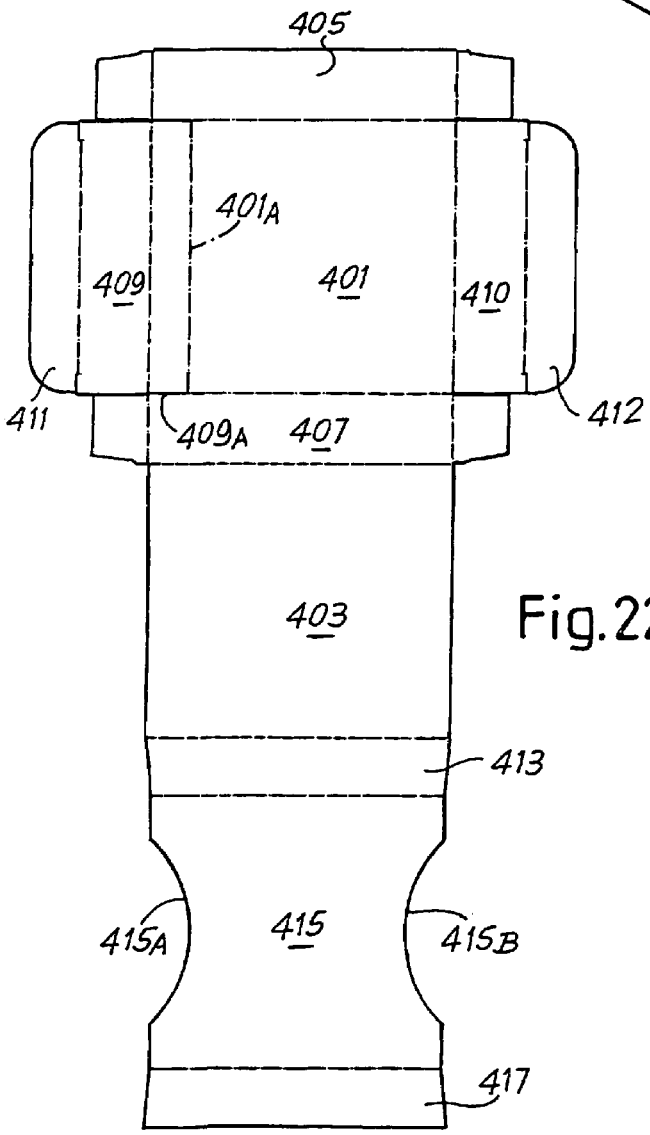

FIGS. 14 and 15; 16 and 17; 18 and 19 show in each case an overall view of several tools and a cross-section of a tool ready for use, relating to three further examples;

FIGS. 20 and 21 show a set of tools with a view of the punched element unfolded and a cross-section of the folded assembly;

FIGS. 22 and 23 show a box able to receive the assembly according to FIGS. 20 and 21, in the unfolded condition and in the assembled condition with parts removed;

FIGS. 24 and 25; 26 and 27; 28 and 29; 30 and 31; 32 and 33 show fives examples of embodiment of boxes with appendages for forming the tools, in the extended separating condition and in the assembled semi-open condition.

FIGS. 1 and 3 show a first example of a cardboard tool provided in accordance with the invention. This tool consists of a strip 1 of cardboard which has, in a middle position, a hole 3 able to receive the neck C of a glass phial F, which must be opened by breaking a breakage zone T with a narrowed cross-section; a weakened folding line 5, extending transversely with respect to the strip 1, is provided so as to coincide with the hole 3. This arrangement defines two leaves 1A, 1B which extend from the zone where the hole 3 and the folding line 5 are situated. A small extension 1C of one 1B of the leaves 1A, 1B is folded back along a line 7 and is glued to the end of the leaf 1A. In order to obtain a convenient shape of the tool, a further two transverse weakened folding lines, denoted by 9, may advantageously be provided, said lines being positioned symmetrically with respect to the hole 3 at a limited distance from the middle folding line 5.

The tool thus formed may be stored flat, i.e. with the leaves 1A, 1B being arranged alongside each other so as to keep the overall dimensions as small as possible. When the tool must be used, it is deformed in the manner indicated in FIGS. 2 and 3, with a small degree of splaying which moves the folding lines 9 away from each other. The neck of the phial is then inserted in the direction of the arrow fA of FIG. 3 inside the hole 3, so that the neck is situated between the two leaves 1A and 1B. The phial is positioned with respect to the tool so that the breakage section T corresponds substantially to the edges of the hole 3. In these conditions the user may press the two leaves 1A and 1B in the direction of the two arrows fT so as to grip the neck C and cause breakage in the zone T by means of relative inclination of the neck C and the phial F; the user's fingers remain perfectly positioned offset from the neck C and therefore the breakage zone so that the breaking operation does not give rise to any risk of injuring the fingers of the user's hand who is pressing in the direction of the two arrows ft, while the fingers which are gripping the phial F—which is of considerable size—are not affected in any case by the breakage operation. The neck of the phial is in practice retained between the two leaves 1A and 1B and may be disposed of together with the tool formed by the strip 1, without the risk of any form of injury. Moreover, the tool could also be used again for further operations.

Advantageously—but not necessarily—the tool as defined above may have a window, such as an additional hole 10, in a position at a small distance from the hole 3 and at a small distance also from one of the folding lines 9, so as to allow the user to check the angular position of the phial F, the neck of which frequently may be provided with a reference mark C1; it is thus possible to direct the phial angularly and bring the reference mark C1 opposite the window or hole 10, so that the phial F is positioned in the best position for exerting the breaking force by means of the operation described above; in fact, the phial in this way may be oriented so as to have in the correct position the zone which facilitates most breakage, which zone is distinguished precisely by means of the reference mark C1.

Again advantageously—but not necessarily—the tool described above may have one or more longitudinal facing ribs 1F (see in particular FIG. 1) which slightly deform the edge of the hole 3 and thus facilitate the insertion of the neck C in the direction of the arrow fA in FIG. 3; moreover these ribs create respective cradles in which the neck C of the phial rests when inserted between the two leaves 1A and 1B.

The two leaves 1A and 1B need not be glued to each other using the extension 1C as indicated in FIGS. 1 and 3. In this case the tool assumes the form shown in FIGS. 4 and 5 where the tool is defined by the reference numbers corresponding to those used in FIGS. 1 to 3 with the addition of "10". The two leaves 11A and 11B have the same length and the transverse weakened folding line C15 is central with respect to the hole 13; the ribs 11F, and if necessary the window or hole 20, may also be optionally provided. The tool in this case may be kept in the flattened condition and therefore with a small thickness. If necessary by way of an alternative, the tool may be designed so as to be folded along the transverse folding line 15 and the two ends of the leaves 11A and 11B joined together in a gluing zone indicated by 11C.

Figure 6:
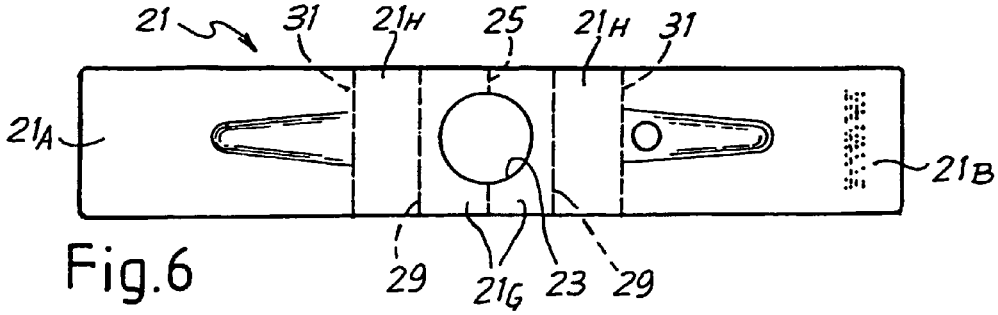
FIGS. 6 and 7 show a third example of a tool in the open condition and at the time of use.
Figure 7:
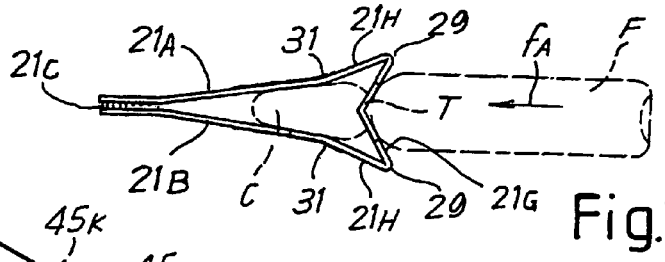

FIGS. 6 and 7 show a further embodiment of the tool which is substantially equivalent to that of the preceding examples, with the reference numbers increased by "20" compared to those used in FIGS. 1 to 3 and with the addition of "10" compared to the reference numbers used in FIGS. 4 and 5 respectively. In this embodiment the strip 21 has two transverse folding lines 29 and two additional weakened folding lines 31 which are symmetrically positioned on the outside and at the same distance from the hole 23 and from the respective folding lines 29. In this case, in the strip 21, in addition to the two zones 21G between the folding lines 25 and 29, two additional zones 21H between the folding lines 29 and 31 are also defined. The strip 21 may be kept flattened, as shown in FIG. 6 until use or may be folded along the transverse folding line 25 and if necessary glued using the ends of the two leaves 21A and 21B, as indicated by 21C in FIG. 7.

For use of the tool shown in FIGS. 6 and 7, the strip is folded along the lines 31 so as to splay slightly the zones 21H and, after folding along the lines 29, the zones 21G are bent inwards between the two zones 21H, as shown clearly in FIG. 7; this may be performed or in any case completed with the insertion of the phial in the direction of the arrow fA in FIG. 7. Differently from that which can be obtained with the embodiments according to FIGS. 1 to 5, in the case of FIGS. 6 and 7, a further protection for the user is provided with the formation of protective parts consisting of the zones 21G and 21H which also cover the shoulder which the phial F forms in the breakage zone T; in this case the breakage zone T is in a certain sense partially embedded between the two thicknesses consisting of the zones 21G and 21H in the condition illustrated in FIG. 7, providing greater protection for the operator's fingers.

Figure 8:
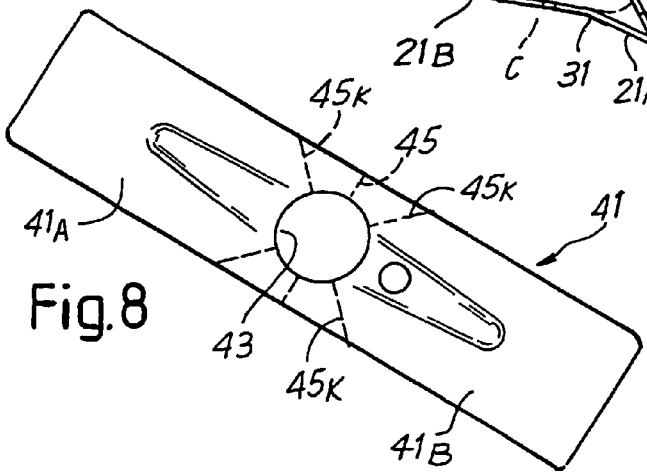
FIGS. 8, 9 and 10 show three further examples of tools.

FIG. 8 shows an embodiment which is substantially similar to that of the preceding examples, with a slight modification in the ribs representing folding lines with which the strip, indicated by 41, is provided in the zone of the hole 43 (corresponding to the hole 3 or 13 or 23) and symmetrically with respect to the weakened folding line 45 (corresponding to the lines 5, 15 and 25); these different folding lines indicated by 45K are symmetrical with respect to the hole 43 and inclined so as to create in any case the possibility of adaptation of the two leaves 41A and 41B of the strip 41 to the breakage zone T of the phial. The function is similar to that of the folding lines 9 or 19 and the ribs such as that 1F and 11F or equivalent.

Figure 9:
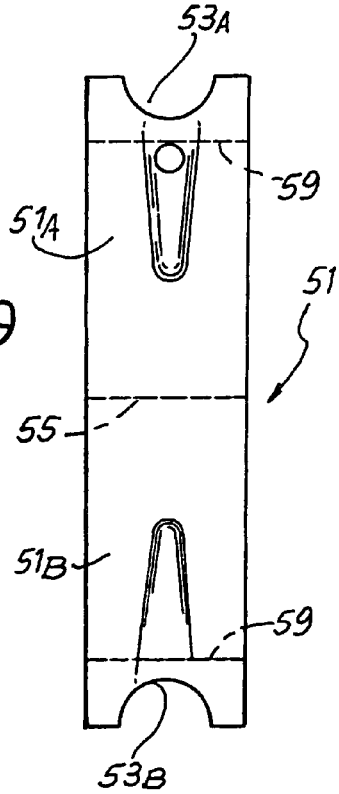

In the variation of embodiment shown in FIG. 9, the cardboard strip 51 has, in the intermediate position, a weakened folding line 55 which defines two leaves 51A and 51B; these two leaves have at their respective ends recesses 53A and 53B which, together with the fold along the line 55, perform a function equivalent to that of the hole 3 or 13 or 23 of the preceding examples; the recesses may also be followed by weakened folding lines indicated by 59. In this case, by folding the strip 51 along the line 55, the two leaves 51A, 51B are arranged next to each other. The ends of these leaves may also be folded further so as to be brought up to each other and cover the shoulder of the phial F which corresponds to the breakage zone T, while the two leaves 51A and 51B are arranged alongside the neck C. In this case also, by pressing the leaves 51A and 51B against the neck of the phial and retaining the body of the phial F, it is possible to perform breakage of the neck without danger for the operator.

Figure 10:
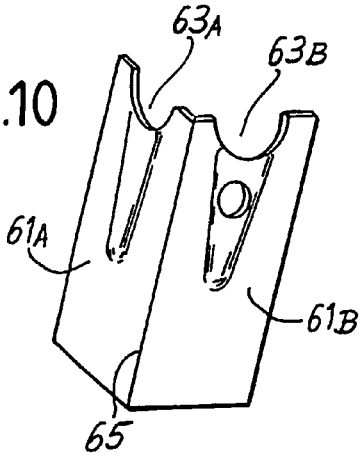

FIG. 10 shows a further variation of embodiment in which a substantially rectangular cardboard element has a longitudinal middle folding line 65 for defining two leaves 61A and 61B hinged in a book-like manner and performing the function of the leaves of the preceding examples when they are arranged alongside each other by folding along the line 65. Each of the two leaves 61A and 61B has two recesses 63A and 63B which, with folding along the line 65, allow seating of the neck of the phial between the two leaves and breakage to be performed in a similar manner to that already described above and with, in this case also, suitable protection for the operator.

These two last embodiments according to FIGS. 9 and 10 may envisage longitudinal ribs equivalent to the ribs 1F and a hole equivalent to the hole 10, for the functions equivalent to those already described for the first examples of embodiment described above.

The design of a tool according to the solutions described above allows the formation of a set of several tools which may be individually separated from each other so as to then be used for the functions of breaking phials contained inside multiple packaging having a more or less limited number of phials.

FIGS. 11 to 13 show a set of five tools of the type similar those described above, which are formed by a single sheet-like element of cardboard with breakage lines 70 which allow the separation, from each other, of strips 71 similar to those 1, with a hole 73 similar to the hole 3. Folding lines 75, 79 similar to folding lines 5 and 9 and any ribbed impressions 71F similar to those 1F and a hole 80 similar to the hole 10, as well as a folding line 77, create individual tools by means of the joining together of zones 71A, 71C of each strip with gluing at 71H so as to obtain elements such as those illustrated in FIGS. 12 and 13. This set may be supplied together with the packaging containing the phials, or separately from the latter, also as a promotional or advertising means. The individual tools are separated from the set by detaching them along the cutting and separating line 70. By dispensing with the zones 71C and with gluing to the leaf 71A, it is possible to provide a sheet of uniform thickness, from which individual tools may be detached.

FIGS. 14 and 15 show a similar set, unfolded in FIG. 14 and in cross-section, of the tools which are connected together and can be detached from each other. In this case the element is substantially similar to that shown in FIGS. 11 to 13 and, in said element, the reference numbers correspond to those of the example according to FIGS. 1 to 13 with the addition of "100". The differences compared to the example shown in FIGS. 11 to 13 consist in the fact that the zone 171C is smaller than the zone 71C and is joined, by means of gluing, to the zone 171A. The punched element according to FIGS. 14 and 15 also has a continuous flap 183 which may be used for information concerning the use of the tools to be detached as strips 171 and for other information also of an advertising nature. The flap 183 remains intact following detachment, one by one, of the individual strips 171 which are shaped so as to form the individual tools as shown in FIG. 15.

Figure 16:
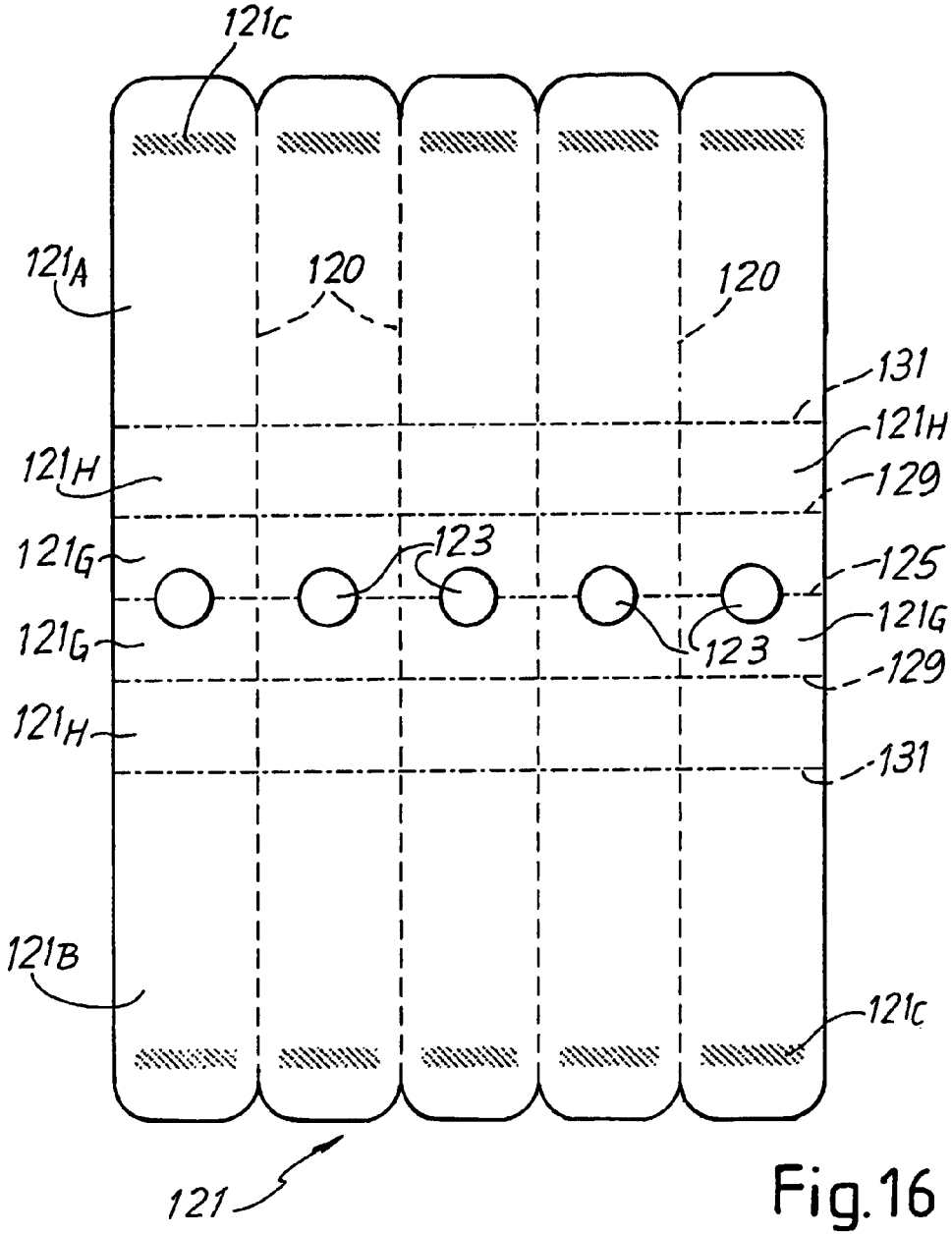
Figure 17:
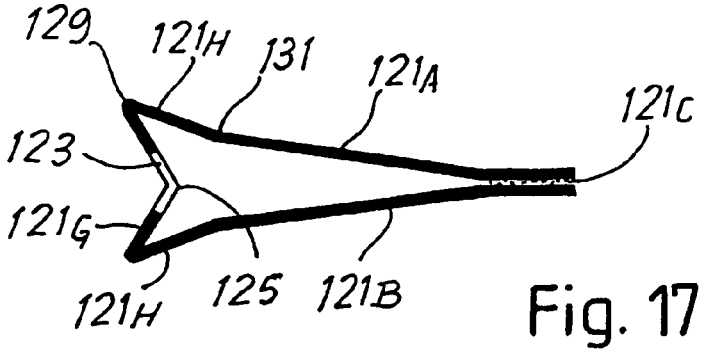

FIGS. 16 and 17 show a further example of a set of strip-like tools, each substantially similar to that shown in the example according to FIGS. 6 and 7. The set according to FIGS. 16 and 17 consists of a cardboard sheet-like element which, by means of pre-cut lines 120, may be divided into a corresponding number of strips 121 which are similar to those 21 and are each formed as the strip 21 and for which the same reference numbers as the example according to FIGS. 6 and 7 increased by "100" are used. The strips 121 may be detached from each other so as to form a tool similar to that of FIGS. 6 and 7. The ends of the zones 121A and 121B may not be glued together and therefore the assembly may consist of a flattened sheet-like element; or the assembly may be joined by means of gluing of the leaves 121A and 121B in a zone 121C so as to form the tool with the joint as indicated by 121H in FIG. 17. Use of each of the tools, separated along the pre-cut lines 120, is performed as illustrated with reference to FIGS. 6 and 7.

Figure 18:
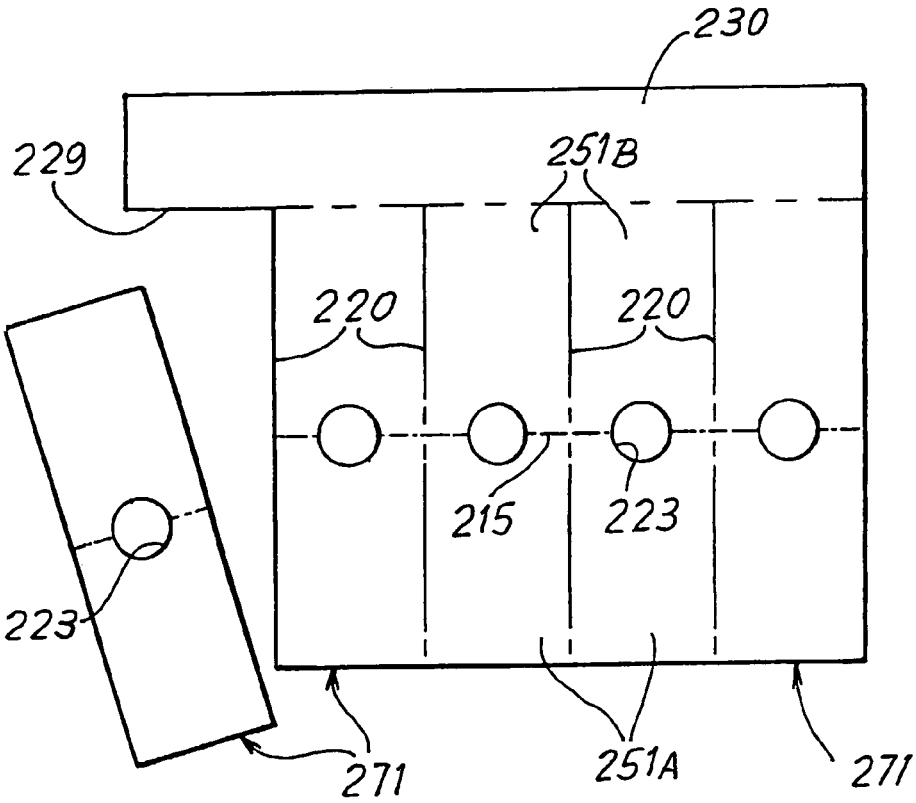
Figure 19:
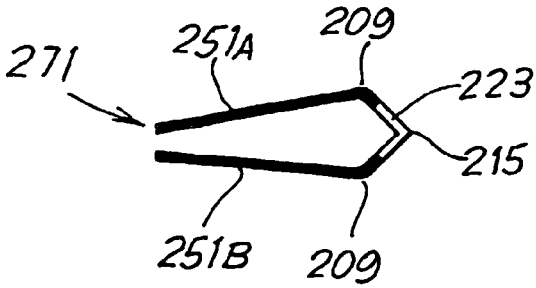

FIGS. 18 and 19 show a further example of a set of tools which can be detached from each other and each consist of a strip 271 which can be separated from the strips arranged alongside by means of pre-cut lines 220 and by a pre-cut line 229 which separates it from a strip 230 which remains intact after detachment of the individual strips 271. In this embodiment each strip 271 has two zones 251A and 251B which form leaves equivalent to the leaves 11A and 11B of the example according to FIGS. 1 to 3 or FIGS. 4 and 5; the two leaves 251A and 251B are separated by a folding line 215 which is similar to that 5 of the abovementioned example and which corresponds essentially to a diameter of the hole 223 which is equivalent to that 3 and has the same function as the latter. The two leaves 251A and 251B may not be glued and in this case the set is in the form of a sheet and may also be easily housed inside a box which contains a number of phials corresponding to the number of strips 271. A detached strip 271 may be adapted on the neck of the phial by means of light creases as indicated by 209, also without the need to envisage a folding line such as those indicated by 9 of the first example illustrated, to which the strip 271 according to FIGS. 18 and 19 corresponds.

FIGS. 20 and 21 show a further example of a set of breaking tools which can be separated from each other and formed by a sheet-like cardboard element having an extension considerably greater than that of the preceding examples and as much as three times greater than that of FIGS. 18 and 19. This set according to FIGS. 20 and 21 may be used separately or also combined with the box of a packaging for a number of phials which may correspond to the number of strips which are formed there. This set consists of a rectangle 301 which is divided into three approximately square zones 303, 305 and 307 by folding lines 308 and 309. The zone 307 is substantially similar to the set illustrated and described with reference to FIGS. 18 and 19 and therefore is not further described, except for use of the reference numbers in FIGS. 18 and 19 increased by "100", these relating to functions similar to those already described hereinabove. The two zones 303 and 305 on one of the surfaces or on both the opposite surfaces may be used for various types of information, including also information relating to the use of the pharmaceutical with which a set 301 may be combined or also information of an advertising or other nature.

A set such as that shown in FIGS. 20 and 21 may also be advantageously used so that it can housed inside a box such that illustrated in FIGS. 22 and 23.

The box is formed by two front walls 401, 403, by two side walls 405, 407, by two closing flaps 409 and 410 with engaging tongues 411 and 412, all of which in an arrangement which is substantially known; an extension 413, beyond the front wall 403, is used for joining, by means of gluing, to the side 405 so as to create the prism-shaped box which is then closed by means of the closing flaps 409 and 410. The box is completed by a separating wall 415 which extends from the extension 413, said wall having a width which is slightly smaller than the width of the side walls 405 and 407; the separating wall 415 is extended by a stabilizing flap 417 and said separating wall 415 has laterally two recesses 415A. The stabilizing flap 417 will have a width approximately corresponding to that of the extension 413. The closing flap 409 (or if applicable also the closing flap 410) may have a cut 409A along the folding lines between the front wall 401 and the adjacent zones 405, 407 as far as a folding imprint 401A, in order to increase the space for access to the box when the closing flap 409 is raised, so as to allow access inside the box. The box is assembled by joining, by means of gluing, the side wall 405 to the extension 413 which is inside the box. The separating wall 415 is spaced by a small amount from the front wall 401 so as to form inside the box a relatively thin additional pocket 451 which is able to receive the set 301 which is shown in FIGS. 20 and 21 and which is folded over, with the three parts 303, 305 and 307 placed against each other, and stabilized by an optional tongue 303A which may be glued in a detachable manner to the zone 330 of the section 307. The element 301 folded over three times as shown in FIG. 21 may be housed inside this additional pocket 451 and may be easily extracted from this pocket owing to the presence of the recess 415A in the separating wall 415.

FIGS. 24 and 25 show a solution which, with a single punched element, as shown in FIG. 24, forms the box and a set of breaking tools according to the invention, the form of which substantially corresponds to that of the zone 307 in FIGS. 20 to 21 or other equivalent zone from among those described. FIG. 25 shows a longitudinal section through the punched element according to FIG. 24, but in the condition where the completed box is open so that the inside of said box is accessible.

The box is formed by two front walls 601 and 603 and two side walls 605 and 607; the closing flap 609 with closing tongue 611 protrudes from the front wall 601, while the other closing flap 610 protrudes from the front wall 603 and is extended by a closing tongue 612. An appendage 614 is glued inside the side wall 605 in order to complete the box, access to which for filling is achieved by means of raising of one or other of the closing flaps 609 and 610.

The front wall 603 is reduced to perimetral border which internally—by means of a cut or pre-cut line 616—forms a lid 618 hinged along a folding line 620, which may correspond to the folding line separating the side wall 607 and the front wall 603; the lid thus formed allows access to the interior of the box and its contents, for example consisting of a plurality of phials which are visible with raising in the direction of the arrow f618 (see FIG. 25) of the lid 618 about the hinging line 620.

The box thus formed is completed by an extension of the punched element beyond the folding line 622 which defines the side wall 605. This extension comprises a zone 624 having an extension approximately equivalent to or partially less than that of the front walls 601 and 603; said zone 624 is delimited by a folding line 626, from which there extends a zone 628 which has a form substantially corresponding to that of the set shown in FIG. 18 (or other set from among those described) so as to form a plurality of strips 630 which can be separated so as to function as breaking tools in the manner described above with reference to the examples already illustrated. More particularly the zone 628 beyond the folding line 626 has a joining strip 632 from which the strips 630 may be detached along the pre-cut line 634 independently of one another in that that they can be separated along pre-cut lines 636. Each of the strips 630 has—in the example illustrated—a hole 638 and a transverse folding line 640 coinciding with the hole 638 so as form a breaking device entirely equivalent to those already described above.

The assembly consisting of the zone 624 and the zone 628 folded on top of each other along the folding line 626 may be folded down on top of the front wall 603 and the lid 618 which forms part of this front wall and may be raised about the folding line 622 for access inside the box and for detaching and removing the individual strips 630; the tongue 642 may stabilize the closing position of the double layer 624, 628, being inserted inside a window 644 created in the lid 618 of the front wall 603; the surplus material for formation of the window 644 may be glued to the tongue 642.

Figure 26:
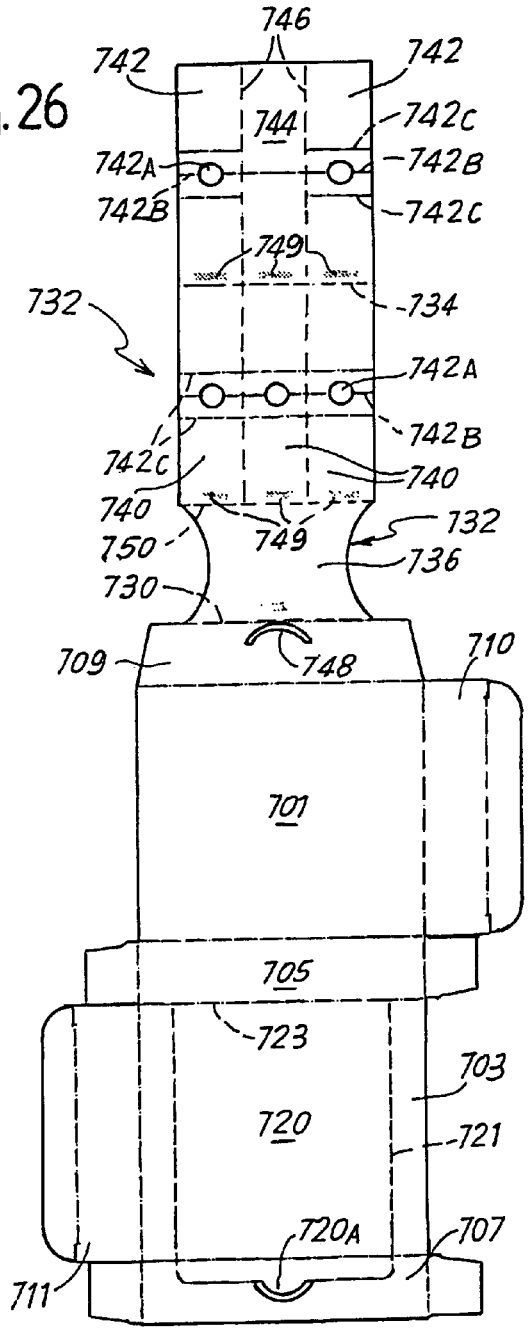
Figure 27:
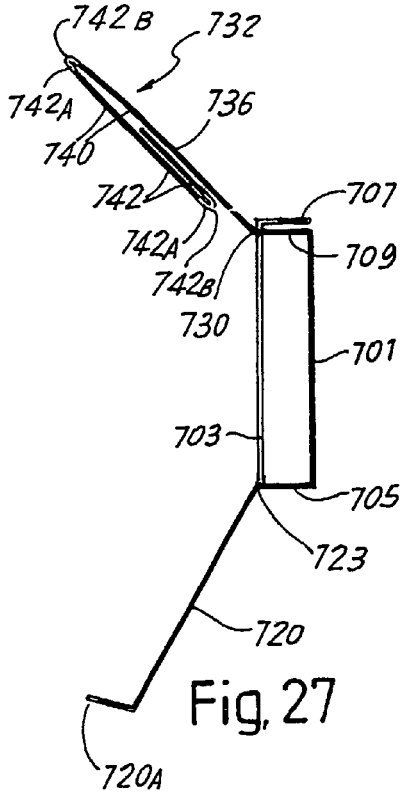

FIGS. 26 and 27 show yet another embodiment of a box, the punched element of which is completed by an appendage, in which strips forming the breakage tools according to the invention are formed.

The box is formed with two front walls 701 and 703, with two side walls 705 and 707 and with an appendage 709 to which the side wall 707 is glued. 710 and 711 denote closing flaps for access inside the box for filling thereof. The front wall 703 extends practically in the manner of a border from which a zone 720 is separated and delimited by a cut or pre-cut line 721 extending also on the side 707 and along the fold delimiting this side wall 707 from the front wall 703; a hinged lid 720 is thus formed along the folding line 723 delimiting the front wall 703 from the side wall 705; the arrangement is similar to that of the lid 518 of the preceding example. The appendage 709 is partly delimited by a folding line 730 from which there extends a long appendage 732 which may be folded along an intermediate transverse pre-cut folding line 734 so as to reduce the length thereof. Beyond the folding line 730, the appendage 732 has a first shaped portion 736 followed by a rectangular zone 738—divided up by the transverse line 734—intended to form a certain number of strip-like breakage devices with a central hole and with any optional folds substantially having the form already described repeatedly above and in particular with three strips 740 adjacent to the shaped portion 736 and with two external strips 742 which are formed beyond the transverse pre-cut folding line 734, which strips 742 are separated by a portion 744. These strips 740 and 742 and the zone 744 are delimited by longitudinal pre-cut lines 746 and by the transverse pre-cut folding line 734 already mentioned. 749 denotes a pair of three gluing points which are used to join together the leaves formed by the strips 740 and 742 forming the respective breakage devices, each having a central hole 742A and a central transverse folding line 742B and any additional transverse folding lines 742C.

The assembly consisting of the appendage 732, reduced lengthwise by means of folding along the transverse pre-cut folding lines 742A and 742B, is folded down on top of the opening of the box (created by the parts 701, 705 and 709) and this appendage thus folded over and down may be retained underneath the front wall 703 and the lid 720, a tongue 720A of which may be inserted inside a slit 248 formed in the zone 709.

With this arrangement the box is completed with a closing lid 720; underneath this lid the assembly consisting of the appendage 732 folded partly into two layers and partly into three layers is situated.

The strips 740, 742 may be detached individually along the pre-cut lines 746 and 734 as well as along the pre-cut line 750 which divides up the shaped portion 736 from the rectangle 738; separation of the individual tools already prepared for operation is thus obtained; the recessed shape of the shaped portion 736 also leaves visible the strips 742 which remain on the inside in the folded-down condition of the appendage 732 opposite the lid and underneath the lid 720, when the lid itself is raised. The visible residual zone of the portion 736 and where applicable also the internal surface of the lid 720 may comprise instructions relating to the mode of use or other instructions useful for use of the set.

Figure 28:
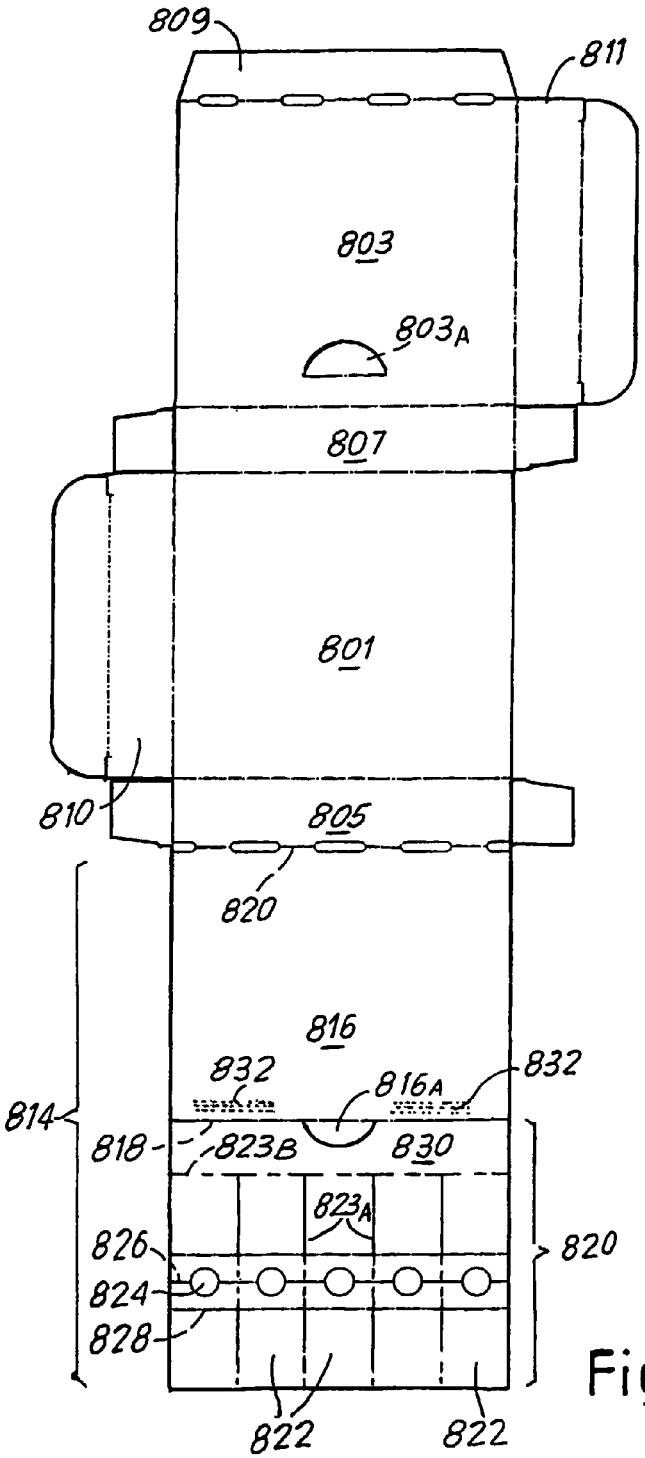
Figure 29:
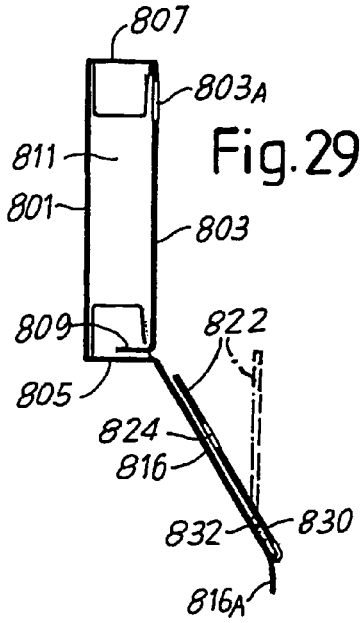

FIGS. 28 and 29 show yet another embodiment of a box with an extension of said punched element for forming, together with said material, also the components which form the devices for breaking the neck of the phial. The box is formed by two front walls 801, 802, by two side walls 805, 807 and by an appendage 809 which is glued inside the side wall 805 so as to close the box; access to the box is allowed by means of opening and closing of one of the closing flaps 810 and 811 protruding laterally from the front walls 801 and 803, respectively. Beyond the side wall 805—delimited by a folding line 820—there extends an appendage 814 which is divided up into a zone 816 having an extension which nearly corresponds to that of the front walls 801 and 803 and which is extended beyond a folding line 818 opposite the folding line 820; beyond this folding line 818 there is a zone 820 which is shaped and configured in the manner of the zone 628 of the solution according to FIG. 24 or in the manner of the set illustrated in FIG. 18 or other equivalent set. The zone 820 forms five strips 822 which are delimited by pre-cut lines 823A and 823B and which have holes 824, folding lines 826 and any further folding lines 828; the breakage devices, which can be separated from the residual strip 830 which remains connected to the folding line 818 of the front wall 816, are thus formed. Limited gluing zones 832 allow joining of the zone 830 to the front wall 816 of the extension 814. A tongue 816A, forming an extension of the front wall 816, allows the double layer 816, 820 of the extension 814 to be kept in the closed position by means of penetration inside a window 803A formed in the front wall 803.

In this case also a box which, together with the punched element, also forms the elements intended to form the breakage devices is obtained.

Figures 30, 31:
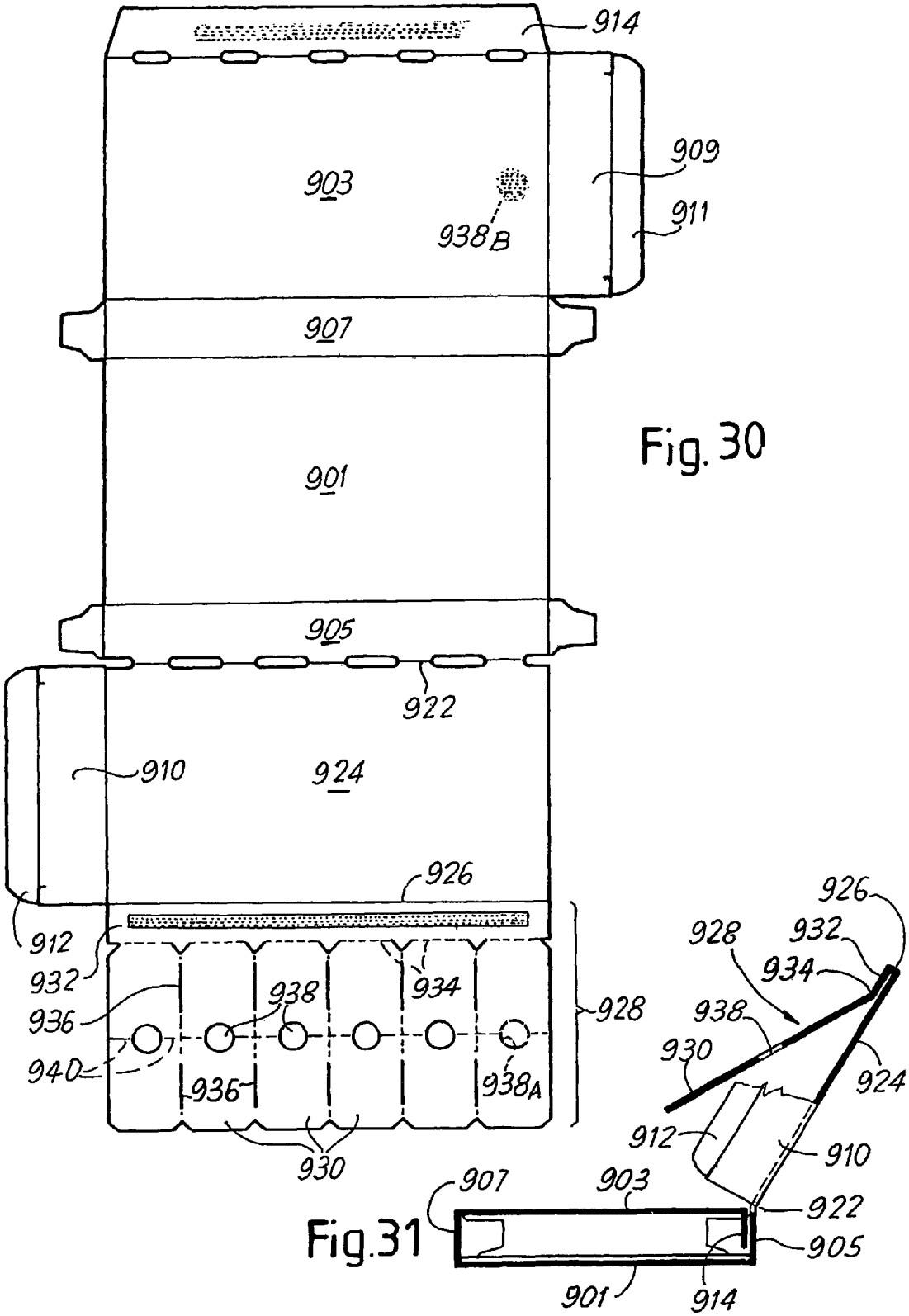

FIGS. 30 and 31 show a solution which, by means of a single punched element, as shown in FIG. 30, allows the formation of a box which is closed on the two front walls and is accessible with an opening on one of the two shorter sides forming the closing flaps.

The box is formed by the two front walls 901 and 903 and by the two side walls 905 and 907; a closing flap 909 with closing tongues 911 protrudes from the front wall 903. An appendage 914 is glued inside the side wall 905 in order to complete the box, access to which for filling is obtained by means of raising of the closing flap 909. Beyond the folding line 922 which defines the side wall 905, an extended part 924 having an extension approximately equal to that of the front walls 901 and 903 is provided; this extension 924 is delimited by a folding line 926 from which there extends a zone 928 which forms a plurality of strips 930 which can be detached so as to operate as breakage tools in the manner described above with reference to the examples already illustrated. More particularly, the zone 928 beyond the folding line 926 has a joining strip 932 from which the strips 930 may be detached along a precut line 934 independently of each other in that separable along pre-cut lines 936. Each of the strips 930 has a hole 938 and a transverse folding line 940 coinciding with the holes 938 so as to form a breakage device which is entirely equivalent to those already described above. The zone 928 is folded down about the folding line 926 and the joining strip 932 is glued onto the extension 924; one of the holes 938, for example the hole 938A is only partially cut and the material 938A thereof is glued onto the front wall 903 at 938B. In fact, the assembly, formed by the zone 924 and the zone 928 folded on top of each other along the folding line 926, is folded down on top of the front wall 903 and glued at 938B onto said front wall 903; by detaching said assembly from the front wall 903 and raising it, the strips 930 may be raised about the folding line 934 for removal thereof independently of one other; the material 938A remains glued to the front wall 903 at 938B. The extension 924 has laterally the second closing flap 910 with a closing tongue 912 for the box formed by the components 901, 903, 907, 905, 914. This closing flap 910 may be opened for removal from the box.

The box according to FIGS. 30 and 31 has the form of a conventional box, with the sides 903, 907, 901, 905 (with the tongue 914 glued thereto) which may be flattened before filling, the closing flaps 909 and 910 being open and the assembly 924, 928 (932, 930) being stably joined to the front wall 903. The operations for filling and for closing the box are the same as those of conventional boxes. In order to remove the contents, the closing flap 910 may be raised and the assembly 924, 928 raised in order to detach one of the strips 930. The box is closed again by repositioning the assembly 924, 928 against the front wall 903 and closing the closing flap 910 again.

Figure 33:
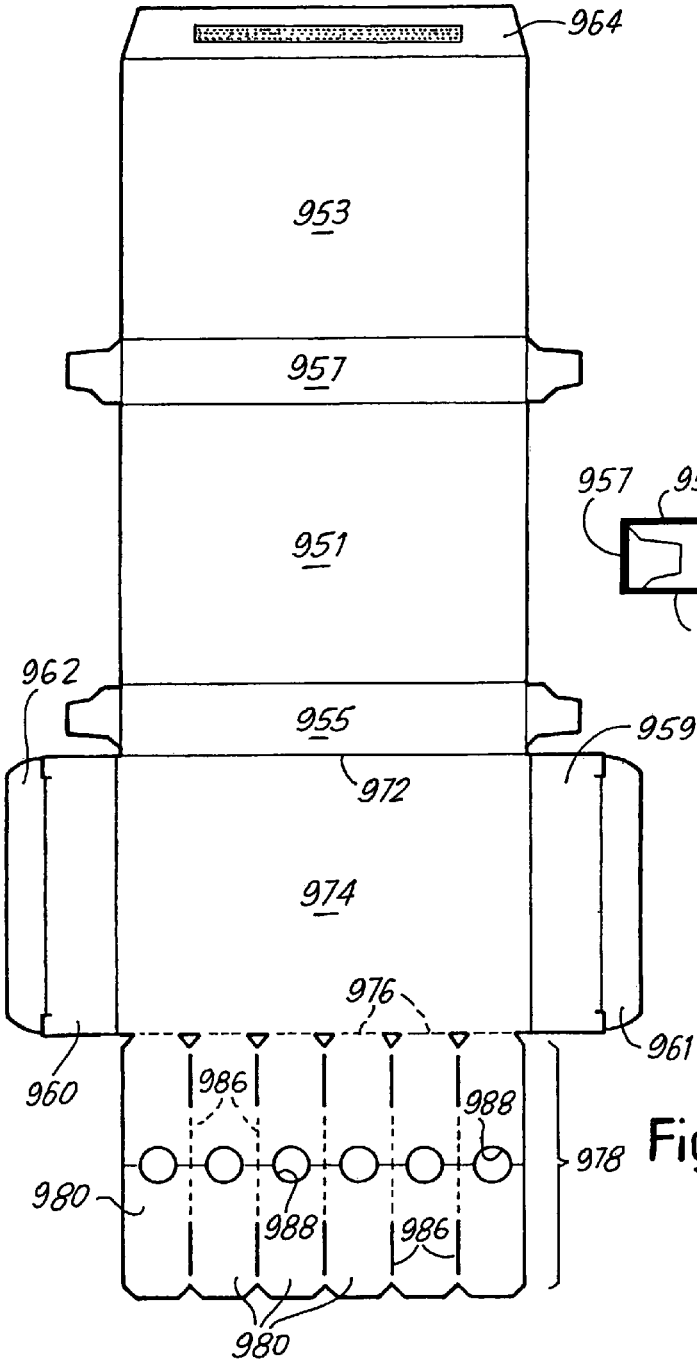
Figure 32:
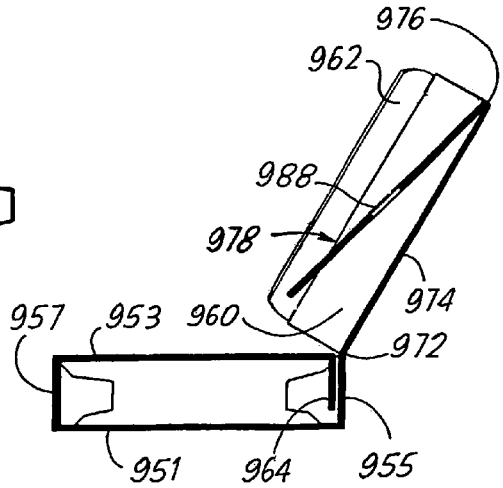

FIGS. 32 and 33 show a box which is similar to that of FIGS. 30 and 31. The box is formed by the front walls 951 and 953 and by the side walls 955 and 957; the appendage 964 is glued to the side wall 955. The extension 974 (similar to the extension 924) extends from the side wall 955, beyond the folding line 972. The two opposite closing flaps 959, 960 with the respective closing tongues 961, 962 protrude laterally from this extension 974. The box is completed, beyond a pre-cut folding line 976 opposite the folding line 972, by a zone 978 formed by the series of strips 980 delimited by pre-cut lines 976 and having the holes 988. The box may remain flattened after gluing together 964 and 955. In order to perform filling, one of the closing flaps 959, 960 may be closed, after positioning the zone 978 against the extension 974 and the assembly 978, 974 against the front wall 953. After filling, the box is closed by means of the other of the closing flaps 959, 960. In order to remove the contents, one of the closing flaps 959, 960 is opened; in order to detach one of the strips 980, the other closing flap is also opened and the extension 974 is raised from the front wall 953.

It is understood that the drawing shows only a simplification provided by way of a practical demonstration of the invention, it being possible for the form and arrangements of the invention to vary without thereby departing from the scope of the idea underlying said invention. The presence of any reference numbers in the accompanying claims has the object of facilitating reading of the claims with reference to the description and to the drawing and does not limit the scope of protection represented by the claims.

The invention claimed is:

1. A tool for facilitating breakage of the neck of a glass vial and protecting the operator from injury to the fingers, the tool comprising:

a piece of cardboard folded such that a box structure is formed for containing at least one glass vial with a neck to be broken, said piece of cardboard having a tool cardboard portion, said tool cardboard portion having at least one vial-breaking tool said tool cardboard portion being folded such that said tool cardboard portion is movable from a position within said box structure to a position outside of said box structure, said at least one vial-breaking tool comprising a strip of cardboard, said strip of cardboard defining a hole in a center position thereof for receiving the neck of the glass vial, said strip having at least one transverse fold defined by a weakened line, said at least one transverse fold coinciding with said hole, said strip being detached from said tool cardboard portion to define a detached strip of cardboard when said tool cardboard portion is in said position outside of said box structure, said detached strip of cardboard being folded along said transverse fold such that two leaves are formed, one leaf being opposite another leaf when said detached strip of cardboard is folded along said transverse fold, each leaf being arranged adjacent to the neck of the glass vial when said neck of said glass vial is inserted into said hole, each leaf defining finger engaging portions, each leaf of said detached strip of cardboard defining a means for receiving a vial breaking force in an area of said finger engaging portions such that the neck of the glass vial breaks.

2. Tool according to claim 1, wherein the two leaves are joined together at the ends opposite to the hole.

3. Tool according to claim 1, wherein each of the two leaves has a first weakening for a transverse fold at a small distance from said hole for adaptation to the shape of the vial.

4. Tool according to claim 3, wherein each of the two leaves also has a second further weakening for a transverse fold at a greater distance from said hole than said first weakening for a transverse fold, so as to allow inward bending of the cardboard between the two leaves in order to adapt the tool to the shoulder of the vial and to the neck thereof.

5. Tool according to claim 1, the two leaves have a longitudinal ribbing which is shaped and convex outwards from said hole so as to create a partial housing for the neck of the vial.

6. Tool according to claim 1, wherein at least one of the leaves has a window for visual inspection of a reference mark provided on the neck of the vial for indicating the direction of the pressure to be exerted for breakage of the vial neck.

7. A tool according to claim 1, wherein one strip of cardboard is integrally connected to another strip of cardboard along pre-cut lines to form an integral strip of detachable individual tools, each tool being detachable from another tool such that one detached tool is used to remove the neck of the glass vial in a detached state.

8. A tool according to claim 7, wherein said integral strip of cardboard comprises a surface in excess of that forming the strip of tools to be detached, which excess surface is used for printing information relating to use of the tools and/or information of an advertising nature and/or relating to the product contained in the vial of a packaging which also contains said strip of tools.

9. A tool according to claim 8, wherein the surface in excess of the strip of tools from which the strip of tools are obtained forms two zones which can be folded over so as to form a three-layer assembly.

10. A tool according to claim 7, wherein said strip of tools is formed as an appendage of a punched element for the formation of a box intended to form the packaging for which said strip of tools is intended, said appendage being handled with the operations for forming the box, being hinged by means of a folding line with a component of said punched element.

11. A box according to claim 10, wherein one of the two front walls is formed as a contour of a lid defined by a cut or pre-cut line and by a folding line forming a hinge.

12. A tool for facilitating breakage of the neck of a glass vial for pharmaceuticals, the tool comprising:

a piece of cardboard folded such that a box structure is formed, said box structure containing one or more vials with a neck to be broken, said piece of cardboard having a cardboard portion detachably connected thereto, said cardboard portion being integrally connected to said box structure such that said cardboard portion is movable from a position located in said box structure to a position located outside of said box structure, said cardboard portion including at least one tool detachably connected thereto, said at least one tool comprising a cardboard element with at least one pre-folded fold line defining a first finger receiving section and a second finger receiving section, said first finger receiving section being symmetrical to said second finger receiving section, said cardboard element defining a glass vial neck receiving hole for receiving the neck of a glass vial, said pre-folded fold line being located on each side of said glass vial receiving hole in a direction transverse of a width of said cardboard element, said cardboard element being detached from said box structure when said cardboard portion is in said position located outside of said box structure, said cardboard element being folded to a folded position when said cardboard element is detached from said cardboard portion such that said first finger receiving section is opposite said second finger receiving section and said first receiving section and said second finger receiving section extend in a direction opposite of the neck of glass vial, said first finger receiving section and said second finger receiving section being adjacent to the neck of the glass vial when said cardboard element is in said folded position, said first finger receiving section and said second finger receiving section defining an abutment, whereby said abutment receives a force for breaking the neck of the glass vial.

13. A box for containing glass vials with a neck to be broken, made with a punched element forming walls of the box partly delimited by folding lines, the box comprising:

a single piece of cardboard, said single piece of cardboard being folded along a plurality of defined fold lines such that a box structure is formed having a plurality of cardboard side walls, said single piece of cardboard including an appendage and a cardboard portion integrally connected thereto, said appendage being connected to an interior surface of one of the cardboard side walls of the box structure, said cardboard portion being connected to said one of said cardboard walls along one of said defined fold lines, said one of said defined fold lines being adjacent to said appendage, said cardboard portion being movable from a first position to a second position, said cardboard portion being located in said box structure in said first position, said cardboard portion being located at a position outside of said box structure in said second position, said cardboard portion forming a strip of detachable cardboard tools, each tool being connected to an adjacent tool via a pre-cut line in an attached state, one of said tools being detached from another of said tools and said box structure in a detached state when said cardboard portion is in said second position, each tool having a hole for receiving a neck of a glass vial and two finger engaging sections longitudinally extending on each side of said hole, each tool having a transverse fold extending a width of said tool, one of said tools being folded along said transverse fold in said detached state such that the neck of the glass vial is perpendicular to said transverse fold when the neck of the glass vial is inserted into said hole.

14. A box according to claim 13, wherein said appendage is folded over at least twice and is glued in zones of adjacent surfaces.

15. A box according to claim 13, wherein said appendage forms at least one of the closing flaps of the box with which said appendage is hinged.

16. A box according to claim 15, wherein said appendage is engaged, against one of the front walls of the box, with the material of the hole of one of the strips which is defined by a pre-cut line, said material being glued to said front wall.

17. A box according to claim 15, wherein said appendage forms laterally both the closing flaps of the box.

18. A box for containing glass vials with a neck to be broken, the box comprising:

a punched piece of cardboard having pre-folded lines defining two front walls, two side walls, two closing flaps, an appendage and a detachable cardboard portion having a strip of detachable tools, said piece of cardboard being folded such that said appendage is connected to one of said side walls and one of said front walls is opposite another front wall and one of said closing flaps is opposite another of said closing flaps and one of said side walls is opposite another of said side walls to form a box structure, said cardboard portion being connected to said one of said side walls along one of said pre-folded lines such that said cardboard portion is movable from a first position to a second position, said cardboard portion with said strip of detachable tools being located within said box structure in said first position, said cardboard portion with said strip of detachable tools being located at a position outside of said box structure in said second position, said strip of detachable tools being detached one by one from said cardboard portion in a detached state when said cardboard portion is located at said position outside of said box structure for removing a neck of a glass vial, each detachable tool having a hole for receiving a neck of a glass vial and two finger engaging sections, each finger engaging section extending in a longitudinal direction of said detachable tool, each detachable tool having a transverse fold extending a width of said tool, one of said tools being folded along said transverse fold in said detached state such that the neck of the glass vial is perpendicular to said transverse fold when the neck of the glass vial is inserted into said hole, each finger engaging section extending in a direction opposite the neck of the glass vial when said one of said tools is folded along said transverse fold.

19. A box in according to claim 18, wherein each finger engaging section defines an abutment, whereby said abutment receives a force from an external source for breaking the neck of the glass vial when one of said detachable tools is in said detached state.

20. A box in according to claim 19, wherein one of said front walls is formed as a lid, said detachable strip of tools being folded under said lid such that said detachable strip of tools unfolds when said lid is lifted.

* * * * *